US009492946B2

(12) United States Patent
Meeker et al.

(10) Patent No.: US 9,492,946 B2
(45) Date of Patent: Nov. 15, 2016

(54) SYSTEM FOR UTILIZING RECYCLED ASPHALT PAVEMENT AND METHODS THEREOF

(71) Applicant: Meeker Equipment Co., Inc., Belleville, PA (US)

(72) Inventors: R. Jeffrey Meeker, Harleysville, PA (US); James R. Hurlburt, Jr., Reedsville, PA (US); Donald W. Garrett, Belleville, PA (US); Robert G. Meeker, Lansdale, PA (US); Stephen G. Meeker, Powell, OH (US)

(73) Assignee: Meeker Equipment Co., Inc., Belleville, PA (US)

( * ) Notice: Subject to any disclaimer, the term of this patent is extended or adjusted under 35 U.S.C. 154(b) by 43 days.

(21) Appl. No.: 14/303,176

(22) Filed: Jun. 12, 2014

(65) Prior Publication Data

US 2014/0369155 A1 Dec. 18, 2014

Related U.S. Application Data

(60) Provisional application No. 61/834,370, filed on Jun. 12, 2013.

(51) Int. Cl.

| | |
|---|---|
| ***B28C 5/06*** | (2006.01) |
| ***B28C 5/46*** | (2006.01) |
| ***B28C 5/00*** | (2006.01) |
| ***E01C 19/05*** | (2006.01) |
| ***E01C 19/10*** | (2006.01) |

(52) U.S. Cl.

CPC ..... *B28C 5/003* (2013.01); *E01C 19/05* (2013.01); *E01C 19/1036* (2013.01); *E01C 2019/109* (2013.01); *E01C 2019/1095* (2013.01)

(58) Field of Classification Search

CPC ..... E01C 19/1004; E01C 19/1036; B28C 5/466; B28C 5/003

USPC ..... 366/4, 7

See application file for complete search history.

(56) References Cited

U.S. PATENT DOCUMENTS

| | | | | |
|---|---|---|---|---|
| 4,298,287 | A * | 11/1981 | McCarter, III | E01C 19/1031 366/4 |
| 7,758,235 | B1 | 7/2010 | Collette | |
| 2008/0310249 | A1* | 12/2008 | Musil | E01C 19/1004 366/23 |
| 2010/0000442 | A1* | 1/2010 | Ackerman | E01C 19/1068 366/17 |
| 2012/0170401 | A1 | 7/2012 | Musil | |
| 2012/0263007 | A1 | 10/2012 | Swanson | |

* cited by examiner

*Primary Examiner* — Tony G Soohoo
*Assistant Examiner* — Anshu Bhatia
(74) *Attorney, Agent, or Firm* — Buchanan Ingersoll and Rooney PC

(57) ABSTRACT

A method for utilizing recycled asphalt is provided. In exemplary embodiments, the method may comprise: mixing input feed with at least one of an asphalt rejuvenator and virgin liquid asphalt in a pre-coater/mixer; allowing the at least one of the asphalt rejuvenator and the virgin liquid to soften residual asphalt in the input feed and encapsulate any fine particles; discharging the mixture into a spiral section; feeding the mixture into a rotary dryer comprising a counterflow zone and a temperature elevation zone; activating the drying process and directing a heated air stream into the rotary dryer through a rotating chamber; allowing a portion of the heated air to escape through the counterflow zone and into the temperature elevation zone; liberating surface moisture from the mixture along with a portion of the heated air via an outlet; processing the exhaust from the system; and discharging a finished mixture.

20 Claims, 3 Drawing Sheets

SYSTEM FOR UTILIZING RECYCLED ASPHALT PAVEMENT AND METHODS THEREOF

CROSS-REFERENCE TO RELATED APPLICATIONS

The present application claims priority to U.S. Provisional Patent Application Ser. No. 61/834,370 entitled "System for Utilizing Recycled Asphalt Pavement and Methods Thereof," filed Jun. 12, 2013, the disclosure of which is incorporated herein by reference in its entirety.

BACKGROUND

Field of the Invention

Embodiments of the present invention are generally related to a system for utilizing recycled asphalt pavement and methods thereof. More specifically, embodiments of the present invention relate to methods of utilizing recycled asphalt pavement that may comprise inputting and pre-coating filler materials, activating a drying process, introducing additional additives, processing exhaust, and/or discharging a finished product.

Description of Related Art

Currently recycled asphalt pavement ("RAP") is recycled in a variety of processes through commonly utilized Parallel Flow and Counterflow Drum Mixers and through Batch Plants. It is common to utilize between 10% and 50% RAP in these existing processes. There also are a number of small typically portable processes that can process at or near 100% RAP. Generally these processes have a very low production rate, typically 10 tons per hour (tph) or less.

With the ever-growing need and desire to recycle RAP, Shingles, Rubber, Glass and other materials (OM) that can be used as modifiers or fillers in Asphalt Pavement at elevated production rates a need exists to produce up to a 100% RAP product while maintaining the ability to also produce a mix that superior quality with minimal emissions. All current practices have one or more limiting features that restrict their ability to have the flexibility to utilize a variety of virgin and recycled ingredients. Some problems that exist with currently available equipment is the production of volatile organic compounds (VOCs) when producing high stream. h RAP Mixes and the need for extensive environmental control in the process's exit gas s

SUMMARY

Embodiments of the present disclosure generally relate to a system for utilizing recycled asphalt and methods thereof. In one embodiment, a method for utilizing recycled asphalt may comprise: mixing input feed with at least one of an asphalt rejuvenator and virgin liquid asphalt in a pre-coater/mixer; allowing the at least one of the asphalt rejuvenator and the virgin liquid to soften residual asphalt in the input feed and encapsulate any fine particles; discharging the mixture into a spiral section; feeding the mixture into a rotary dryer comprising a counterflow zone and a temperature elevation zone; activating the drying process and directing a heated air stream into the rotary dryer through a rotating chamber; allowing a portion of the heated air to escape through the counterflow zone and into the temperature elevation zone; liberating surface moisture from the mixture along with a portion of the heated air via an outlet; feeding the mixture through an air baffle into the temperature elevation zone of the dryer; introducing additional additives to the mixture via a material entry collar; allowing the heated air stream to encounter one or more air dams adapted to increase the dwell time and interaction with the mixture as it is mixed with flights; introducing at least one of additional rejuvenator, liquid asphalt, or additional fillers to the mixture via one or more injection lines; processing the exhaust from the system; and discharging a finished mixture.

In another embodiment of the present disclosure, a method for utilizing recycled asphalt may comprise: mixing input feed with at least one of an asphalt rejuvenator and virgin liquid asphalt in a pre-coater/mixer; allowing the at least one of the asphalt rejuvenator and the virgin liquid to soften residual asphalt in the input feed and encapsulate any fine particles; discharging the mixture into a spiral section; feeding the mixture into a rotary dryer comprising a counterflow zone and a temperature elevation zone; activating the drying process and directing a heated air stream at a point approaching the center of the rotary dryer, the heated air stream created by firing an industrial burner into an insulated combustion chamber located outside the rotary dryer; allowing a portion of the heated air to escape through the counterflow zone and into the temperature elevation zone; liberating surface moisture from the mixture along with a portion of the heated air via an outlet; feeding the mixture through an air baffle into the temperature elevation zone of the dryer; introducing additional additives to the mixture via a material entry collar; allowing the heated air stream to encounter one or more air dams adapted to increase the dwell time and interaction with the mixture as it is mixed with flights; introducing at least one of additional rejuvenator, liquid asphalt, or additional fillers to the mixture via one or more injection lines; processing the exhaust from the system by allowing the exhaust from the temperature elevation zone to proceed through a low velocity knock out block to promote the separation of any particulate matter that has become entrained in the air stream; and discharging a finished mixture.

In yet another embodiment of the present disclosure, a system for utilizing recycled asphalt may comprise: a pre-coater for mixing an input feed with at least one of asphalt rejuvenator and virgin liquid asphalt and discharging the mixture; a spiral section adapted to receive the discharged mixture, the spiral section comprising a drum spiral section adapted to allow the at least one of asphalt rejuvenator and virgin liquid asphalt to soften any residual asphalt in the discharged mixture and encapsulate any fine particles; a rotary dryer comprising a counterflow zone for liberating surface moisture from the mixture and a temperature elevation zone comprising one or more air dams adapted to allow for dwell time; a burner for creating a heated air stream within the rotary dryer; a material entry collar for introducing additional additives into the mixture; one or more injection lines for introducing one or more of additional rejuvenator, liquid asphalt, or additional fillers to the mixture; a low velocity knock out block for promoting the separation of any particulate matter in the air stream; and a discharge for discharging the finished mixture.

BRIEF DESCRIPTION OF THE DRAWINGS

So the manner in which the above-recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
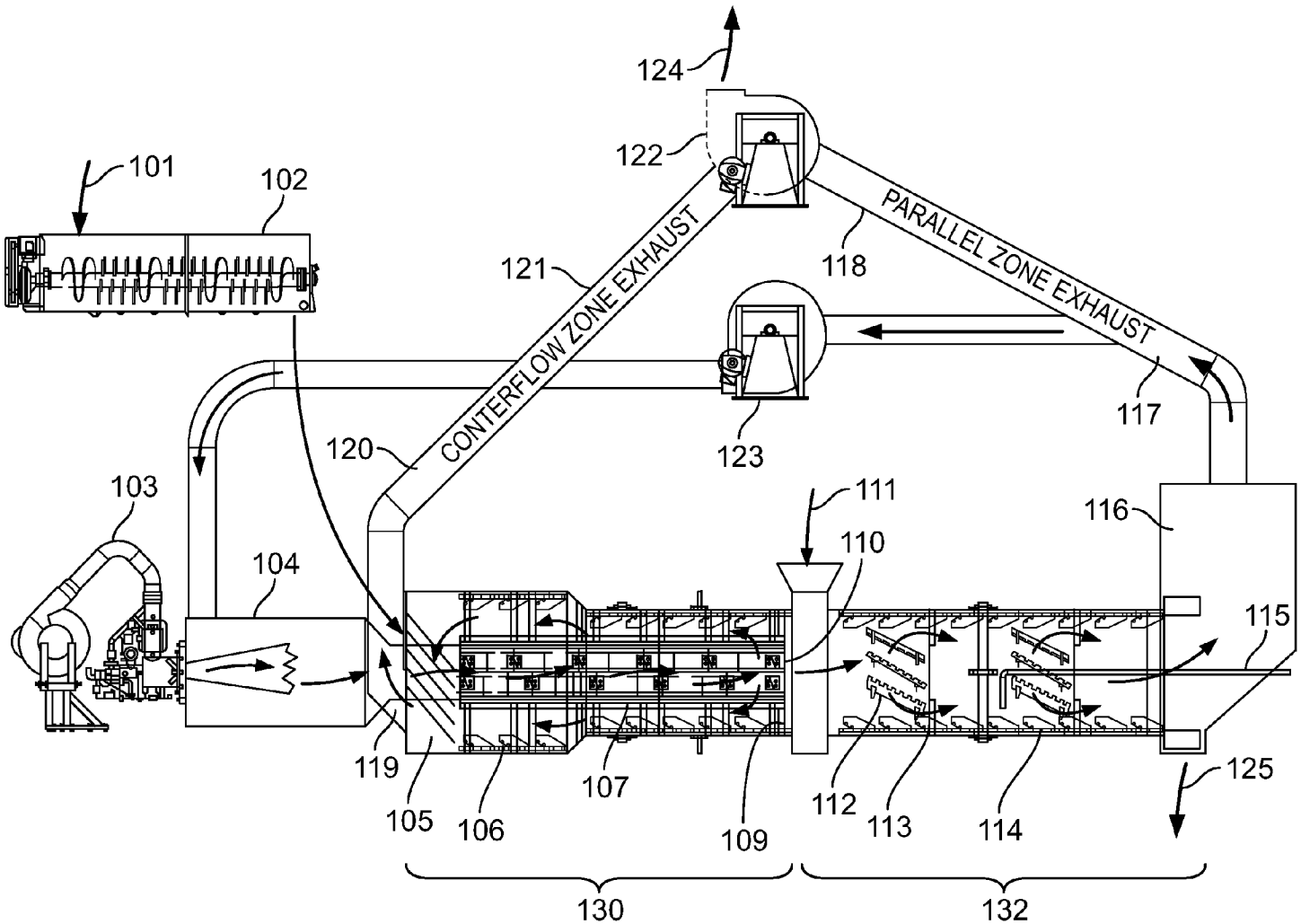
FIG. 1 depicts a plan view of a system for utilizing recycled asphalt in accordance with one embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention are generally related to a system for utilizing recycled asphalt pavement and methods thereof. More specifically, embodiments of the present invention relate to methods of utilizing recycled asphalt pavement that may comprise inputting and pre-coating filler materials, activating a drying process, introducing additional additives, processing exhaust, and/or discharging a finished product.

In the following detailed description, numerous specific details are set forth in order to provide a thorough understanding of exemplary embodiments or other examples described herein. However, it will be understood that these examples may be practiced without the specific details. In other instances, well-known methods, procedures, components and circuits have not been described in detail, so as to not obscure the following description. Further, the examples disclosed herein are for exemplary purposes only and other examples may be employed in lieu of, or in combination with, the examples disclosed. It should also be noted that the examples presented herein should not be construed as limiting of the scope of embodiments of the present invention, as other equally effective examples are possible and likely.

FIG. 1 depicts a view of a system 100 for utilizing recycled asphalt in accordance with embodiments of the present invention. In exemplary embodiments, a system 100 of utilizing recycled asphalt may be adapted to reduce and/or eliminate production of VOCs when producing high RAP mixes and reduce and/or eliminating the need for extensive environmental control in the process's exit gas stream. Exemplary embodiments of the present invention may utilize commercially available delivery systems for some and/or all input feed materials 101, both bulk and liquid, or the like. In some embodiments, input feed materials may comprise one or more of processed recycled asphalt, processed recycled shingles, virgin aggregates, rubber/slag/glass, filler/fines, rejuvenator, and virgin asphalt, or the like.

In accordance with exemplary embodiments, input feed 101 may be mixed with an asphalt rejuvenator and or virgin liquid asphalt in a pre-coater/mixer 102 prior to discharging the mixture into a spiral section 105, or the like. In some embodiments, the spiral section 105 may comprise a drum spiral section. The pre-coating/mixing may allow the rejuvenator and or asphalt to soften the residual asphalt in the RAP and or shingles to encapsulate any fine particles that may normally become airborne in current drying processes. The system 100 may be adapted to allow sufficient dwell time for the asphalt rejuvenator to accomplish its required reaction with the binder on the RAP and/or shingles.

In exemplary embodiments of the present invention, the pre-coated feed may enter the spiral section 105 and a drying/temperature elevation process may begin by means of a heated air stream that is created by firing an industrial burner 103, a heat source, or the like, into an insulated combustion chamber 104, or the like, that may be located outside of a rotary dryer 106, or the like. In exemplary embodiments, the heated air may be ducted and/or directed into a dryer 106, for example, through a rotating chamber. In some embodiments, a rotating chamber may be formed by individual flights that, when assembled, may create a rotating duct 107, or the like. A system 100 in accordance with embodiments of the present invention may allow heated air to be conveyed to a point approaching the center of a drum, or the like.

In exemplary embodiments, as the airflow proceeds down a rotating duct 107, or the like, it may transfer some heat through the duct and into a Counterflow/Moisture removal zone 130 of the dryer 106. As heated air approaches the end of the rotating duct 107, a portion of the heated air may be allowed to escape from the duct into the Counterflow/Moisture removal zone 130 of the dryer 106 by means of cutouts in the individual flights which may form the duct, or the like. In alternative embodiments, cutouts may not be included. In some embodiments, cutouts, combined with an orifice plate 110 on the end of the rotating duct 107 shall be designed so their open area can be changed to balance the percentage of air entering the Counterflow/Moisture removal zone 130 of the dryer and the Temperature elevation/Parallel zone 132 of the dryer.

In accordance with exemplary embodiments, the system 100 may comprise an air baffle 109, or the like. In some embodiments, an air baffle 109 may be installed and adapted to promote separation of two or more zones of the dryer 106. As the pre-coated feed proceeds through the Counterflow/Moisture removal zone 130 of the dryer 106 it may liberate its surface moisture. The surface moisture may be removed along with a portion of the heated air stream via an outlet on the feed end breaching 119 to a counterflow zone exhaust 121, or the like. In some embodiments, as the pre-coated feed proceeds through the air baffle 109, it will enter the temperature elevation or Parallel Flow Zone 132 of the dryer 106. At this point of the drum a conventional material entry collar may be included. In some embodiments, a conventional material entry collar may be adapted to allow additional additives 111 to be introduced to the mixture.

The system 100 may further comprise air dams 113, or the like. As the heated airstream enters a Temperature Elevation or Parallel Flow Zone 132 of the dryer 106, the heated airstream may encounter air dams 113, which may be adapted and/or used to increase the dwell time and interaction with a pre-coated feed as it proceed to be mixed with specially designed flights 114 and/or veiled by other specially designed flights 112. In some embodiments, a section or zone of the drum may be adapted and/or designed to maximize heat transfer from the heated airstream to the pre-coated feed. A section or zone may be adapted to provide one or more injection lines 115, or the like. In some embodiments, one or more injection lines 115 may be adapted to allow the introduction of additional rejuvenator, Liquid asphalt or additional fillers, or the like, as needed.

The exhaust from the Temperature Elevation or Parallel Flow Zone 132 of the dryer 106 may proceed through a large low velocity knock out box 116 to promote the separation of any particulate matter that has become entrained in the air stream. The exhaust from both zones of the drum may be ducted to a common ID fan 122, or the like. A common induced draft (ID) fan 112 may be adapted to be controlled by a Variable Frequency Drive to allow a variation of exhaust volume. Each of the individual zones exhaust ducts may be equipped with an actuated damper 120 and 117, or the like. In some embodiments, the dampers 120, 117 may be controlled so as to vary the percentage of total exhaust volume that is exhausted from each zone. In exemplary embodiments, a Flue-Gas recirculating system may be installed that may be adapted to remove exhaust from the Temperature Elevation or Parallel Flow Zone exhaust duct 118 and re-introduce it to an insulated combustion chamber 104, or the like. In some embodiments, exhaust may be re-introduced to the insulated combustion chamber 104 via a Variable Frequency Controlled ID Fan 123, or the like.

In exemplary embodiments, the system 100 may be adapted to allow the re-introduction of any liberated VOC's in the exhaust steam to be incinerated in the insulated combustion chamber 104, or the like. Further, in exemplary embodiments, the system 100 may be adapted to provide a means of tempering the heated gas stream temperature to lower outlet temperatures. In some embodiments, a finished product may be discharged from a plant 125, or the like. In some embodiments, a finished product may be discharged to a commercially available transfer and or storage device, or the like. Process Exhaust Gas Stream 124 may be exhausted either to atmosphere or through an appropriate available control device for particulate or Blue smoke as required by the regulating authority at the install location.

Figure 2:
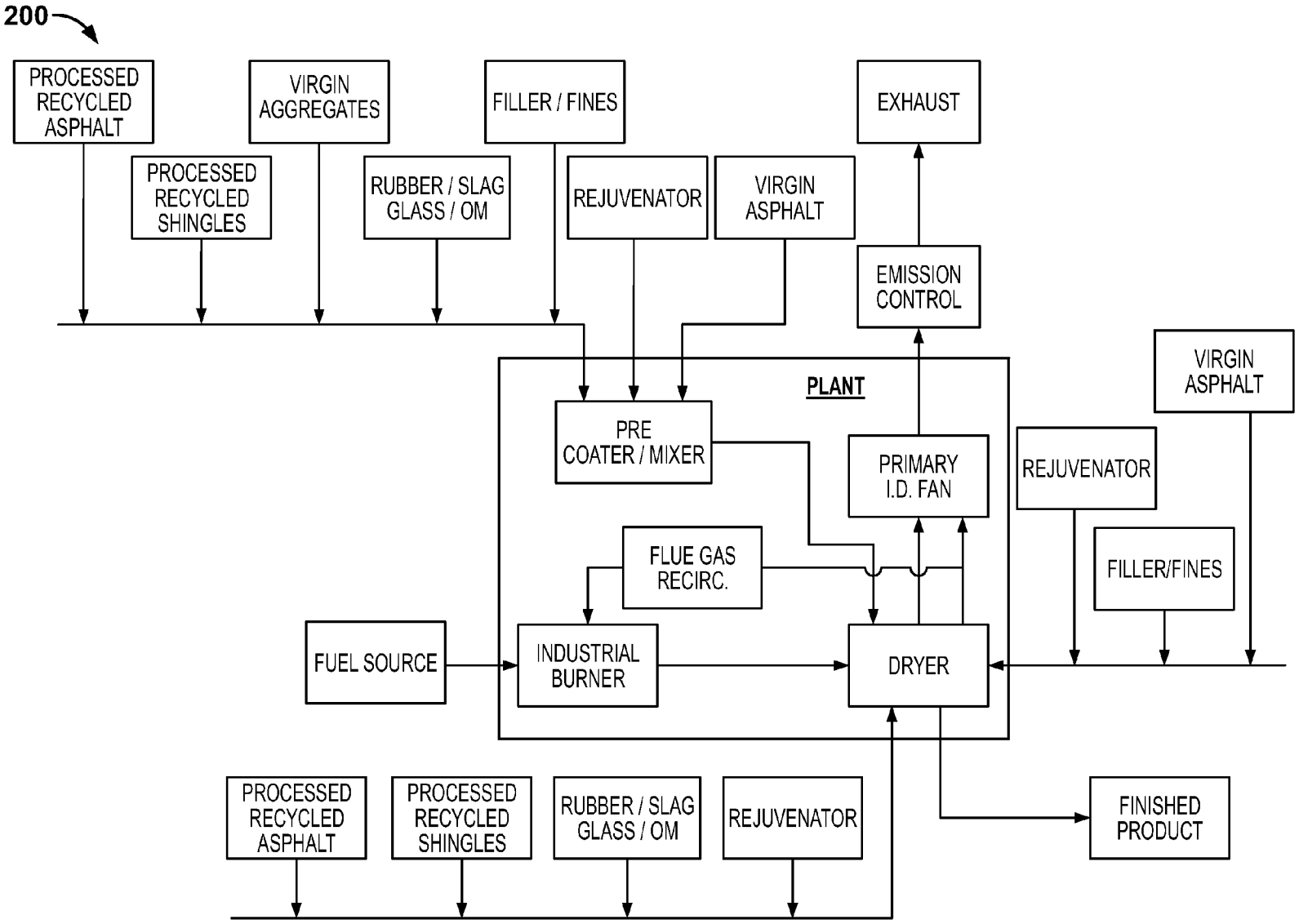
FIG. 2 depicts block diagram of a system for utilizing recycled asphalt in accordance with one embodiment of the present invention.

FIG. 2 depicts block diagram 200 of the system 100 of FIG. 1 adapted to use recycled asphalt in accordance with embodiments of the present invention.

Figure 3:
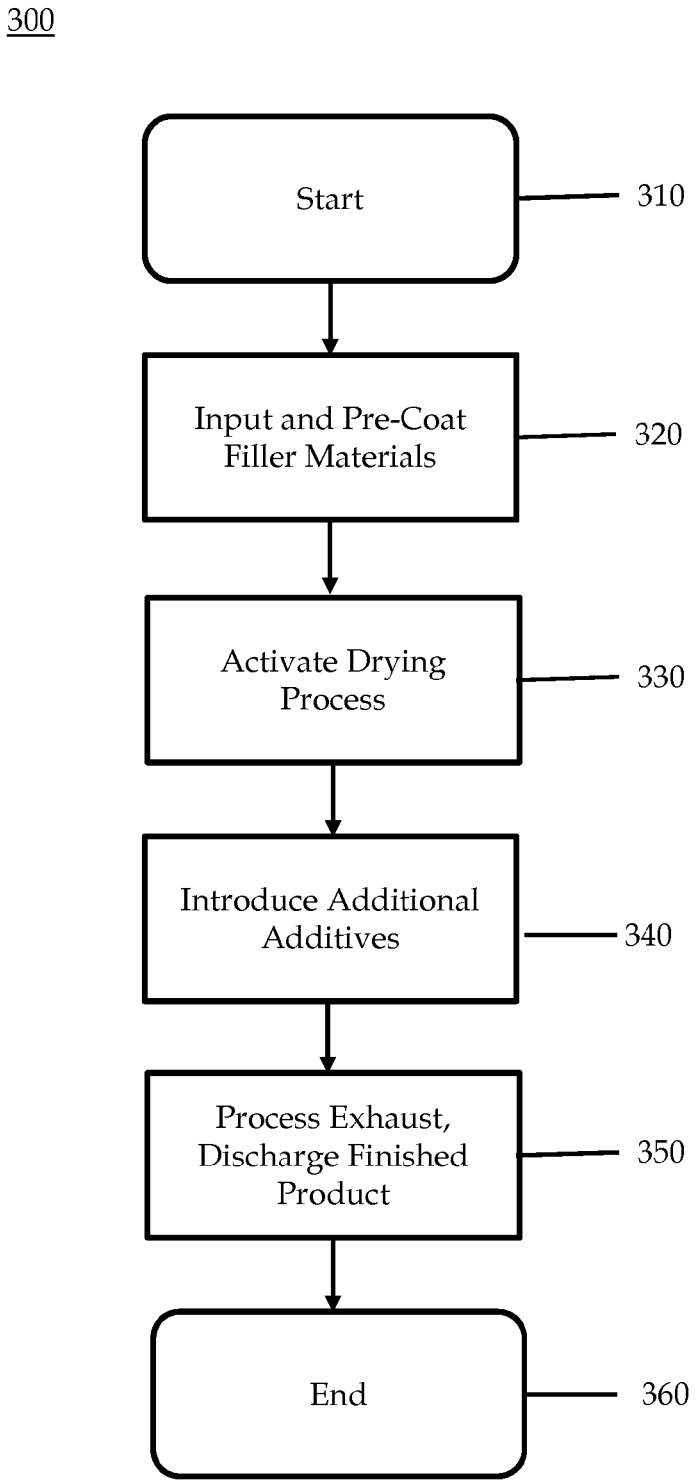
FIG. 3 depicts a method for using a system for utilizing recycled asphalt in accordance with embodiments of the present invention.

Referring now to FIG. 3, a flowchart of an exemplary method 300 of using a system for utilizing recycled asphalt in accordance with embodiments of the present invention is depicted. The method begins at step 310. For ease, the method 300 is described herein with reference to the system 100 examples illustrated in FIGS. 1-2. At step 320, a system for utilizing RAP may be provided and an input feed 101 may be mixed with an asphalt rejuvenator and or virgin liquid asphalt in a pre-coater/mixer 102 prior to discharging the mixture into a spiral section 105, or the like. In some embodiments, the spiral section 105 may comprise a drum spiral section. The pre-coating/mixing may allow the rejuvenator and or asphalt to soften the residual asphalt in the RAP and or shingles to encapsulate any fine particles that may normally become airborne in current drying processes. The system 100 may be adapted to allow sufficient dwell time for the asphalt rejuvenator to accomplish its required reaction with the binder on the RAP and/or shingles.

In exemplary embodiments at step 330, a drying process may be activated. In exemplary embodiments of the present invention, the pre-coated feed may enter the spiral section 105 and a drying/temperature elevation process may begin by means of a heated air stream that is created by firing an industrial burner 103, a heat source, or the like, into an insulated combustion chamber 104, or the like, that may be located outside of a rotary dryer 106, or the like. In exemplary embodiments, the heated air may be ducted and/or directed into a dryer 106, for example, through a rotating chamber. In some embodiments, a rotating chamber may be formed by individual flights that, when assembled, may create a rotating duct 107, or the like. A system 100 in accordance with embodiments of the present invention may allow heated air to be conveyed to a point approaching the center of a drum, or the like.

In exemplary embodiments, as the airflow proceeds down a rotating duct 107, or the like, it may transfer some heat through the duct and into a Counterflow/Moisture removal zone 130 of the dryer 106. As heated air approaches the end of the rotating duct 107, a portion of the heated air may be allowed to escape from the duct into the Counterflow/Moisture removal zone 130 of the dryer 106 by means of cutouts in the individual flights which may form the duct, or the like. In alternative embodiments, cutouts may not be included. In some embodiments, cutouts, combined with an orifice plate 110 on the end of the rotating duct 107 shall be designed so their open area can be changed to balance the percentage of air entering the Counterflow/Moisture removal zone 130 of the dryer and the Temperature elevation/Parallel zone 132 of the dryer.

In accordance with exemplary embodiments, the system 100 may comprise an air baffle 109, or the like. In some embodiments, an air baffle 109 may be installed and adapted to promote separation of two or more zones of the dryer 106. As the pre-coated feed proceeds through the Counterflow/Moisture removal zone 130 of the dryer 106 it may liberate its surface moisture. The surface moisture may be removed along with a portion of the heated air stream via an outlet on the feed end breaching 119. In some embodiments, as the pre-coated feed proceeds through the air baffle 109, it will enter the temperature elevation or Parallel Flow Zone 132 of the dryer 106.

In exemplary embodiments, at step 340, additional additives may be added. At this point of the drum a conventional material entry collar may be included. In some embodiments, a conventional material entry collar may be adapted to allow additional additives 111 to be introduced to the mixture. The system 100 may further comprise air dams 113, or the like. As the heated airstream enters a Temperature Elevation or Parallel Flow Zone 132 of the dryer 106, the heated airstream may encounter air dams 113, which may be adapted and/or used to increase the dwell time and interaction with a pre-coated feed as it proceed to be mixed with specially designed flights 114 and/or veiled by other specially designed flights 112. In some embodiments, a section or zone of the drum may be adapted and/or designed to maximize heat transfer from the heated airstream to the pre-coated feed. A section or zone may be adapted to provide one or more injection lines 115, or the like. In some embodiments, one or more injection lines 115 may be adapted to allow the introduction of additional rejuvenator, Liquid asphalt or additional fillers, or the like, as needed.

In exemplary embodiments, at step 350 the exhaust from the system 100 may be processed and/or the finished product may be discharged. The exhaust from the Temperature Elevation or Parallel Flow Zone 132 of the dryer 106 may proceed through a large low velocity knock out box 116 to promote the separation of any particulate matter that has become entrained in the air stream. The exhaust from both zones of the drum may be ducted to a common ID fan 122, or the like. A common ID fan 112 may be adapted to be controlled by a Variable Frequency Drive to allow a variation of exhaust volume. Each of the individual zones exhaust ducts may be equipped with an actuated damper 120 and 117, or the like. In some embodiments, the dampers 120, 117 may be controlled so as to vary the percentage of total exhaust volume that is exhausted from each zone. In exemplary embodiments, a Flue-Gas recirculating system may be installed that may be adapted to remove exhaust from the Temperature Elevation or Parallel Flow Zone exhaust duct 118 and re-introduce it to an insulated combustion chamber 104, or the like. In some embodiments, exhaust may be re-introduced to the insulated combustion chamber 104 via a Variable Frequency Controlled ID Fan 123, or the like.

In exemplary embodiments, the system 100 may be adapted to allow the re-introduction of any liberated VOC's in the exhaust steam to be incinerated in the insulated combustion chamber 104, or the like. Further, in exemplary embodiments, the system 100 may be adapted to provide a means of tempering the heated gas stream temperature to lower outlet temperatures. In some embodiments, a finished product may be discharged from a plant 125, or the like. In some embodiments, a finished product may be discharged to a commercially available transfer and or storage device, or the like. Process Exhaust Gas Stream 124 may be exhausted either to atmosphere or through an appropriate available control device for particulate or Blue smoke as required by the regulating authority at the install location. The method 300 may be repeated as many times as necessary to produce a finished product in accordance with embodiments of the present invention. When a desired amount of finished product is produced, the system 100 may be deactivated and, the method may ends at step 360.

While the foregoing is directed to embodiments of the present invention, other and further embodiments of the invention may be devised without departing from the basic scope thereof. It is also understood that various embodiments described herein may be utilized in combination with any other embodiment described, without departing from the scope contained herein.

What is claimed is:

1. A method for utilizing recycled asphalt comprising:

mixing input feed with at least one of an asphalt rejuvenator and virgin liquid asphalt in a pre-coater/mixer to generate a mixture;

allowing the at least one of the asphalt rejuvenator and the virgin liquid to soften residual asphalt in the input feed and encapsulate any fine particles;

discharging the mixture into a spiral section;

feeding the mixture into a rotary dryer comprising a counterflow zone and a temperature elevation zone;

activating a drying process and directing a heated air stream into the rotary dryer through a rotating chamber;

allowing a portion of the heated air to escape through the counterflow zone and into the elevation temperature elevation zone;

liberating surface moisture from the mixture along with a portion of the heated air via an outlet;

feeding the mixture through an air baffle into the temperature elevation zone of the dryer;

introducing additional additives to the mixture via a material entry collar;

allowing the heated air stream to encounter one or more air dams adapted to increase a dwell time and an interaction with the mixture as it is mixed with flights;

introducing at least one additional rejuvenator, liquid asphalt, or additional fillers to the mixture via one or more injection lines;

processing an exhaust from the from the system; and discharging a finished mixture;

wherein a common induced draft fan is controlled by a variable frequency drive to allow a variation of exhaust volume; and wherein the exhaust from both the counterflow zone and the temperature elevation zone may be ducted to the common induced draft fan.

2. The method of claim 1, wherein the drying process comprises directing the heated air stream at a point approaching the center of the rotary dryer, the heated air stream created by firing an industrial burner into an insulated combustion chamber located outside the rotary dryer.

3. The method of claim 1, wherein the input feed comprises at least one of processed recycled asphalt processed recycled shingles, virgin aggregates, rubber, slag, glass, filler, fines, rejuvenator, and virgin asphalt.

4. The method of claim 1, wherein the rotating chamber comprises individual flights that create a rotating duct when assembled.

5. The method of claim 4, wherein the portion of the heated air escapes further to the counterflow zone and the temperature elevation zone via cutouts in the individual flights.

6. The method of claim 1, further comprising balancing a percentage of air entering the counterflow zone of the dryer and the temperature elevation zone via an orifice plate.

7. The method of claim 1, wherein the air baffle separates two or more zones of the dryer.

8. The method of claim 1, wherein processing the exhaust comprises allowing the exhaust from the temperature elevation zone to proceed through a low velocity knock out block to promote the separation of any particulate matter that has become entrained in the air stream.

9. The method of claim 1 further comprising controlling dampers to vary a percentage of total exhaust volume that is exhausted from each zone.

10. The method of claim 9 further comprising activating a flue-gas recirculating system adapted to remove exhaust from the temperature elevation zone and reintroduce it to an insulated combustion chamber.

11. The method of claim 1, further comprising re-introducing any liberated volatile organic compounds in the exhaust stream to be incinerated in an insulated combustion chamber.

12. A method for utilizing recycled asphalt comprising:

mixing input feed with at least one of an asphalt rejuvenator and virgin liquid asphalt in a pre-coater/mixer to generate a mixture;

allowing the at least one of the asphalt rejuvenator and the virgin liquid to soften residual asphalt in the input feed and encapsulate any fine particles;

discharging the mixture into a spiral section;

feeding the mixture into a rotary dryer comprising a counterflow zone and a temperature elevation zone;

activating a drying and directing a heated air stream at a point approaching the center of the rotary dryer, the heated air stream created by firing an industrial burner into an insulated combustion chamber located outside the rotary dryer;

allowing a portion of the heated air to escape through the counterflow zone and into the elevation temperature elevation zone;

liberating surface moisture from the mixture along with a portion of the heated air via an outlet;

feeding the mixture through an air baffle into the temperature elevation zone of the dryer;

introducing additional additives to the mixture via a material entry collar;

allowing the heated air stream to encounter one or more air dams adapted to increase a dwell time and an interaction with the mixture as it is mixed with flights;

introducing at least one additional rejuvenator, liquid asphalt, or additional fillers to the mixture via one or more injection lines;

processing an exhaust from the from the system by allowing the exhaust from the temperature elevation zone to proceed through a low velocity knock out block to promote separation of any particulate matter that has become entrained in the air stream; and discharging a finished mixture and;

re-introducing any liberated volatile organic compounds in the exhaust stream to be incinerated in an insulated combustion chamber.

13. The method of claim 12, wherein the input feed comprises at least one of processed recycled asphalt processed recycled shingles, virgin aggregates, rubber, slag, glass, filler, fines, rejuvenator, and virgin asphalt.

14. The method of claim 12, further comprising balancing a percentage of air entering the counterflow zone of the dryer and the parallel zone via an orifice plate.

15. The method of claim 12, wherein exhaust from both the counterflow zone and the temperature elevation zone may be ducted to a common induced draft (ID) fan.

16. A method for utilizing recycled asphalt comprising:

mixing input feed with at least one of an asphalt rejuvenator and virgin liquid asphalt in a pre-coater/mixer to generate a mixture;

allowing the at least one of the asphalt rejuvenator and the virgin liquid to soften residual asphalt in the input feed and encapsulate any fine particles;

discharging the mixture into a spiral section;

feeding the mixture into a rotary dryer comprising a counterflow zone and a temperature elevation zone;

activating a drying process and directing a heated air stream into the rotary dryer through a rotating chamber;

allowing a portion of the heated air to escape through the counterflow zone and into the temperature elevation zone;

liberating surface moisture from the mixture along with a portion of the heated air via an outlet;

feeding the mixture through an air baffle into the temperature elevation zone of the dryer;

introducing additional additives to the mixture via a material entry collar;

allowing the heated air stream to encounter one or more air dams adapted to increase a dwell time and an interaction with the mixture as it is mixed with flights;

introducing at least one of additional rejuvenator, liquid asphalt, or additional fillers to the mixture via one or more injection lines;

processing an exhaust from the system; and discharging a finished mixture;

re-introducing any liberated volatile organic compounds in the exhaust stream to be incinerated in an insulated combustion chamber.

17. The method of 16, further comprising controlling dampers to vary a percentage of total exhaust volume that is exhausted from each zone.

18. The method of claim 16, further comprising activating a flue-gas recirculating system adapted to remove exhaust from the temperature elevation zone and reintroduce it to an insulated combustion chamber.

19. The method of claim 16, further comprising re-introducing any liberated volatile organic compounds in the exhaust stream to be incinerated in an insulated combustion chamber.

20. The method of claim 16, wherein the drying process comprises directing the heated air stream at a point approaching the center of the rotary dryer, the heated air stream created by firing an industrial burner into an insulated combustion chamber located outside the rotary dryer.

* * * * *